US009109608B2

(12) United States Patent
Little et al.

(10) Patent No.: US 9,109,608 B2
(45) Date of Patent: Aug. 18, 2015

(54) COMPRESSOR AIRFOIL TIP CLEARANCE OPTIMIZATION SYSTEM

(75) Inventors: David A. Little, Chuluota, FL (US); Zhengxiang Pu, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 816 days.

(21) Appl. No.: 13/326,399

(22) Filed: Dec. 15, 2011

(65) Prior Publication Data

US 2013/0156578 A1 Jun. 20, 2013

(51) Int. Cl.
*F04D 29/16* (2006.01)
*F04D 29/052* (2006.01)
*F01D 11/22* (2006.01)

(52) U.S. Cl.
CPC ..... *F04D 29/164* (2013.01); *F04D 29/052* (2013.01); *F01D 11/22* (2013.01)

(58) Field of Classification Search
CPC ..... F01D 11/20; F01D 5/06; F04D 29/052; F04D 29/051
USPC ..... 415/173.1, 173.2, 173.7, 173.4, 174.1, 415/129, 131, 132, 140
See application file for complete search history.

(56) References Cited

U.S. PATENT DOCUMENTS 2,762,559 A * 9/1956 Faught ..... 415/17
2,938,705 A * 5/1960 Moore ..... 415/190
4,354,687 A 10/1982 Holland et al.
4,371,311 A * 2/1983 Walsh ..... 415/220
5,203,673 A * 4/1993 Evans ..... 415/173.2
6,676,372 B2 * 1/2004 Scholz et al. ..... 415/173.2
2002/0110451 A1 8/2002 Albrecht, Jr. et al.
2006/0140755 A1 * 6/2006 Schwarz et al. ..... 415/173.2
2007/0065287 A1 * 3/2007 Suciu et al. ..... 416/198 R
2008/0267769 A1 10/2008 Schwarz et al.
2009/0014964 A1 1/2009 Pu et al.
2011/0229301 A1 * 9/2011 Miller ..... 415/1
2013/0129478 A1 * 5/2013 Braun et al. ..... 415/60

FOREIGN PATENT DOCUMENTS

CN 1088655 A 6/1994

* cited by examiner

*Primary Examiner* — Nathaniel Wiehe
*Assistant Examiner* — Eldon Brockman

(57) ABSTRACT

A compressor airfoil tip clearance optimization system for reducing a gap between a tip of a compressor airfoil and a radially adjacent component of a turbine engine is disclosed. The turbine engine may include ID and OD flowpath boundaries configured to minimize compressor airfoil tip clearances during turbine engine operation in cooperation with one or more clearance reduction systems that are configured to move the rotor assembly axially to reduce tip clearance. The configurations of the ID and OD flowpath boundaries enhance the effectiveness of the axial movement of the rotor assembly, which includes movement of the ID flowpath boundary. During operation of the turbine engine, the rotor assembly may be moved axially to increase the efficiency of the turbine engine.

14 Claims, 2 Drawing Sheets

COMPRESSOR AIRFOIL TIP CLEARANCE OPTIMIZATION SYSTEM

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644. Accordingly, the United States Government may have certain rights in this invention.

FIELD OF THE INVENTION

This invention is directed generally to turbine engines, and more particularly to systems for reducing gaps between compressor airfoil tips and aradially adjacent components in turbine engines so as to improve turbine engine efficiency by reducing leakage.

BACKGROUND

Typically, gas turbine engines are formed from a combustor positioned upstream from a turbine blade assembly. The compressor is formed from a plurality of compressor blade stages coupled to discs that are capable of rotating about a longitudinal axis. Each compressor blade stage is formed from a plurality of blades extending radially about the circumference of the disc.

The tips of the compressor blades are located in close proximity to an inner surface of the compressor casing of the turbine engine. There typically exists a gap between the blade tips and the compressor casing of the turbine engine so that the blades may rotate without striking the compressor casing. Likewise, for nonshrouded compressor vanes, there typically exists a gap between the vane tips and an internal rotatable compressor blade and disc assembly so that the rotatable compressor blade and disc assembly may rotate without the compressor vanes contacting the rotatable compressor blade and disc assembly. During operation, gases pass the compressor blades and vanes and compress to high temperature and pressure. These gases also heat the compressor casing, blades, vanes and discs causing each to expand due to thermal expansion. After the turbine engine has been operating at full load conditions for a period of time, the components reach a maximum operating condition at which maximum thermal expansion occurs. In this state, it is desirable that the gap between the blade tips and the compressor casing of the turbine engine and the gap between the compressor vanes and rotatable compressor blade and disc assembly be as small as possible to limit leakage past the tips of the airfoils.

However, reducing the gap cannot be accomplished by simply positioning the components so that the gap is minimal under full load conditions because the configuration of the components forming the gap must account for warm restart conditions in which the compressor casing and the compressor vane carriers, having less mass than the compressor blade and disc assembly, cools faster than the compressor blade and disc assembly. During a warm restart, the discs expand due to centrifugal forces and the clearances tighten before the casing begins to heat up and expand. Therefore, unless the components have been positioned so that a sufficient gap has been established between the compressor blades and the compressor casing and between the compressor vanes and the rotatable compressor blade and disc assembly under operating conditions, the compressor airfoils may strike the compressor casing or the rotatable compressor blade and disc assembly because the diameter of components forming the compressor casing have not heated up and expanded yet. Collision between the compressor blades and the compressor casing or compressor vanes and the rotatable compressor blade and disc assembly often causes severe airfoil tip rubs and may result in damage. Thus, a need exists for a system for reducing gaps between compressor blade tips and a compressor casing and between compressor vanes and a rotatable compressor blade and disc assembly under full load operating conditions while accounting for necessary clearance under warm startup conditions.

SUMMARY OF THE INVENTION

This invention is directed to a compressor airfoil tip clearance optimization system for reducing a gap between a tip of a compressor blade and a radially adjacent component of a turbine engine. The turbine engine may include radially inward ID and OD flowpath boundaries configured to minimize compressor blade tip clearances during turbine engine operation in cooperation with one or more clearance reduction systems that are configured to move a rotor assembly axially to reduce tip clearance. The configurations of the ID and outward flowpath boundaries enhance the effectiveness of the axial movement of the rotor assembly, which includes movement of the ID flowpath boundary. During operation of the turbine engine, the rotor assembly may be moved axially to increase the efficiency of the turbine engine. The gap exists in the turbine engine so that the tips do not contact the compressor casing while the turbine engine is operating. Reducing the gap during turbine engine operation reduces the amount of hot gas that can pass by the compressor blade tip without imparting a load onto the blade, thereby increasing the efficiency of the turbine engine.

The compressor airfoil tip clearance optimization system may include one or more generally elongated blades having a leading edge, a trailing edge, a tip section at a first end, and a root coupled to the blade at an end generally opposite the first end for supporting the blade and for coupling the blade to a disc of a rotor assembly. The system may also include one or more generally elongated compressor vanes affixed to a stationary component such that the compressor vanes do not rotate with a rotor assembly during turbine engine operation. The system includes a radially inward ID flowpath boundary extending from generally an upstream end of a compressor to generally a downstream end of the compressor, wherein the ID flowpath boundary may be formed in part from a compressor rotor assembly. The system may also include an OD flowpath boundary extending from generally the upstream end of the compressor to generally the downstream end of the compressor, wherein the OD flowpath boundary may be formed in part from a compressor casing. The system may include one or more clearance reduction systems configured to move the rotor assembly axially to reduce tip clearance of the generally elongated blade.

In at least one embodiment, the ID flowpath boundary may increase in distance radially outward from a longitudinal axis when moving axially downstream in a direction from the upstream end to the downstream end. The ID flowpath boundary upstream of the axially downstream inward section may be generally linear. The ID flowpath boundary may increase in distance radially outward when moving axially downstream in a direction from the upstream end toward the downstream end in an axially downstream section of the inward flowpath boundary formed from less than 40 percent of an axial length of the compressor extending upstream from the downstream end of the compressor.

In one embodiment, the OD flowpath boundary may be generally aligned with the longitudinal axis of the compressor in an axial direction. In another embodiment, the OD flowpath boundary may also increase in distance radially outward when moving axially downstream in a direction from the upstream end to the downstream end in an axially downstream section formed from less than 40 percent of an axial length of the compressor extending upstream from the downstream end of the compressor. In yet another embodiment, the OD flowpath boundary upstream of the axially downstream section may be generally linear. The OD flowpath boundary may decrease in distance radially outward when moving axially downstream in a direction from the upstream end to the downstream end in an axially upstream section formed from less than 60 percent of an axial length of the compressor extending downstream from the upstream end of the compressor. In another embodiment, the OD flowpath boundary may decrease in distance radially outward when moving axially downstream in a direction from the upstream end to the downstream end in an axially upstream section formed from less than 20 percent of an axial length of the compressor extending downstream from the upstream end of the compressor. In addition, the ID flowpath boundary may decrease in distance radially outward when moving axially downstream in a direction from the upstream end toward the downstream end in an axially upstream section formed from less than 20 percent of an axial length of the compressor extending downstream from the upstream end of the compressor.

The compressor airfoil tip clearance optimization system may be configured to move the rotor assembly axially to reduce the gap between the tips of the blades and vanes and adjacent turbine components to increase the efficiency of the turbine engine. The compressor airfoil tip clearance optimization system may include any necessary component to facilitate movement of the rotor assembly. The compressor airfoil tip clearance optimization system may include one or more clearance reduction systems configured to move the rotor assembly axially to reduce tip clearance of the generally elongated blade.

During operation, the clearance reduction system is operated to move the rotor assembly axially generally along the longitudinal axis. The rotor assembly may be moved generally upstream to increase the efficiency of the turbine engine by reducing the gaps. During shutdown of the turbine engine, the clearance reduction system may move the rotor assembly downstream to prevent tip damage.

An advantage of this invention is that the gaps between blades and adjacent turbine components are reduced during turbine engine operation, thereby increasing the efficiency of the turbine engine.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
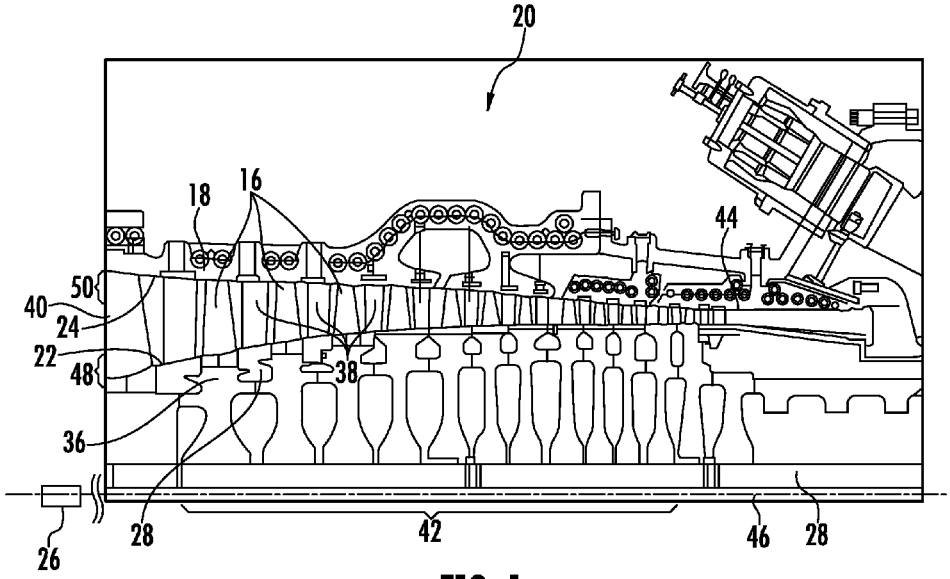
FIG. 1 is a cross-sectional side view of a turbine engine.
Figure 5:
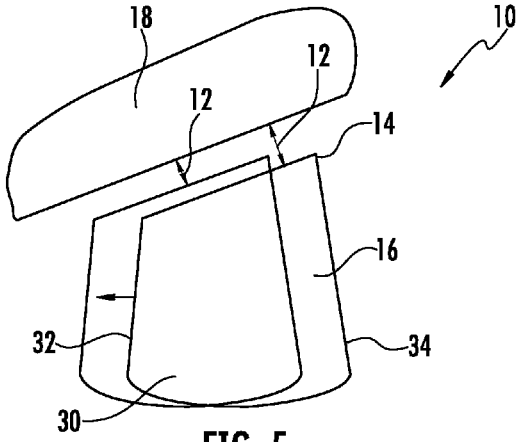
FIG. 5 is a detailed side view showing movement of a compressor airfoil.

As shown in FIGS. 1-5, this invention is directed to a compressor airfoil tip clearance optimization system 10 for reducing gaps 12 between, tips 14 of compressor airfoils, such as compressor blades 16 and compressor vanes 38, and a compressor casing 18 of a turbine engine 20. The gaps 12 exists in the turbine engine 20 so that the tips 14 do not contact radially adjacent components, such as, the compressor casing 18 and the radially inward ID flowpath boundary 22 formed by the compressor rotor assembly 28, while the turbine engine 20 is operating. Reducing the gaps 12 during turbine engine operation, as shown in FIG. 5, reduces the amount of the hot gas that can pass by the compressor blade tip 14 without imparting a load onto the blade 16, thereby increasing the efficiency of the turbine engine 18. The turbine engine 20 including the compressor airfoil tip clearance optimization system 10 may include radially inward ID and radially outward OD flowpath boundaries 22, 24 configured to minimize compressor airfoil tip clearances during turbine engine operation in cooperation with one or more clearance reduction systems 26 that are configured to move a rotor assembly 28 axially to reduce tip clearance. The configurations of the ID and outward flowpath boundaries 22, 24 enhance the effectiveness of the axial movement of the rotor assembly 28, which includes movement of the ID flowpath boundary 22. During operation of the turbine engine, the rotor assembly 28 may be moved axially to increase the efficiency of the turbine engine 20.

A compressor blade 16 of the compressor airfoil tip clearance optimization system 10 may include one or more generally elongated blades 30 having a leading edge 32, a trailing edge 34, the tip section 14 at a first end, and a root 36 coupled to the blade 30 at an end generally opposite the first end for supporting the blade 30 and for coupling the blade 30 to a disc of a rotor assembly 28. One or more generally elongated compressor vanes 38 may be affixed to a stationary component 18 such that the compressor vane 38 does not rotate with a rotor assembly 28 during turbine engine operation. An ID flowpath boundary 22 may extend from generally an upstream end 40 of a compressor 42 to generally a downstream end 44 of the compressor 42. The ID flowpath boundary 22 may be formed in part from a compressor rotor assembly 28. The optimization system 10 may also include an OD flowpath boundary 24 extending from generally the upstream end 40 of the compressor 42 to generally the downstream end 44 of the compressor 42. The OD flowpath boundary 24 may be formed in part from the compressor casing 18.

The tip clearance optimization system 10 may be configured to move the rotor assembly 28 axially to reduce the gap 12 between the tips 14 of airfoils, including the blades 16 and vanes 38, and adjacent turbine components to increase the efficiency of the turbine engine 20. The tip clearance optimization system 10 may include any necessary component to facilitate movement of the rotor assembly 28. The tip clearance optimization system 10 may include one or more clearance reduction systems 26 configured to move the rotor assembly 28 axially to reduce tip clearance of the generally elongated blade 30.

Figure 2:
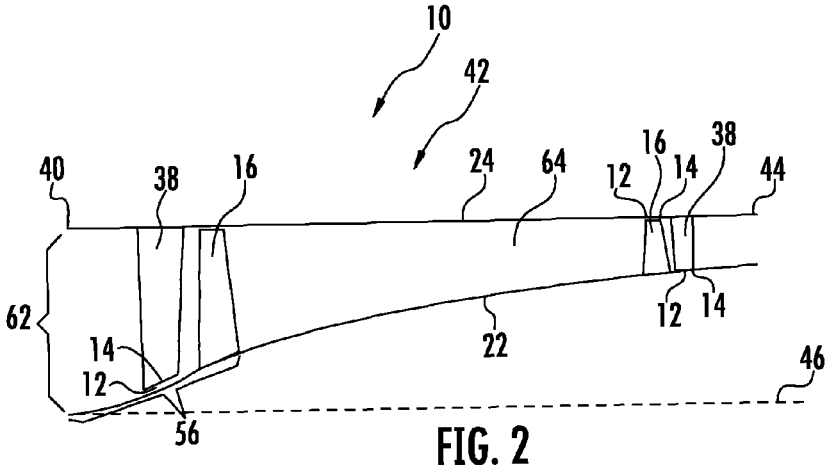
FIG. 2 is a schematic side view of a compressor of the turbine engine with radially outward OD and inward ID flowpath boundaries.
Figure 3:
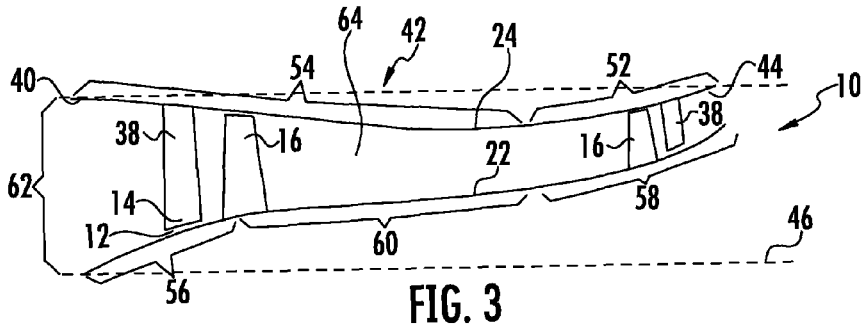
FIG. 3 is a schematic side view of an alternative embodiment of a compressor of the turbine engine with radially outward OD and inward ID flowpath boundaries.
Figure 4:
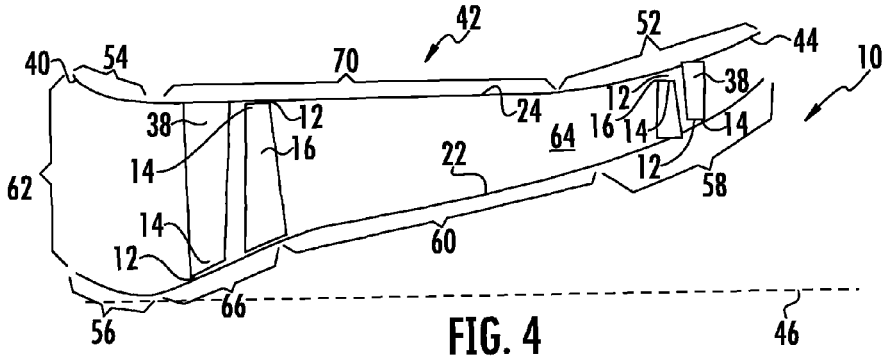
FIG. 4 is a schematic side view of an alternative embodiment of a compressor of the turbine engine with radially outward OD and inward ID flowpath boundaries.

In at least one embodiment, as shown in FIGS. 2-4, the ID flowpath boundary 22 may increase in distance radially outward from a longitudinal axis 46 when moving axially downstream in a direction from the upstream end 40 to the downstream end 44. As shown in the embodiment in FIG. 2, the OD flowpath boundary 24 may be generally aligned with the longitudinal axis 46 of the compressor 42 in an axial direction. The constant OD flowpath boundary 24 may be matched to the continually increasing ID flowpath boundary 24 such that the gaps 12 in the ID region 48 are reduced upon axial, forward movement of the rotor assembly 28 while the gaps 12 in the OD region 50 remain unchanged. An upstream section 56 of the ID flowpath boundary 22 may have a slope that is greater than other portions of the ID flowpath boundary 22. The upstream section 56 may be up to about 40 percent of the length of the compressor 42 extending downstream from the upstream end 40.

As shown in FIG. 3, the OD flowpath boundary 24 may increase in distance radially outward when moving axially downstream in a direction from the upstream end 40 to the downstream end 44 in an axially downstream section, 52 formed from about less than 40 percent of an axial length of the compressor 42 extending upstream from the downstream end 44 of the compressor 42. The OD flowpath boundary 24 of FIG. 3 may decrease in distance radially outward when moving axially downstream in a direction from the upstream end 40 to the downstream end 44 in an axially upstream section 54 formed from less than 60 percent of an axial length of the compressor 42 extending downstream from the upstream end 40 of the compressor 42. A midstream section 60 of the ID flowpath boundary 22 of FIG. 3 may be generally aligned with the longitudinal axis 46 when moving axially downstream in a direction from the upstream end 40 to the downstream end 44. In addition, the ID flowpath boundary 22 of FIG. 3 may include upstream and downstream sections 56, 58 in which the ID flowpath boundary 22 has a steeper slope than a midstream section 60. The upstream section 56 may be up to about 40 percent of the length of the compressor 42 extending downstream from the upstream end 40. The downstream section 58 may be up to about 40 percent of the length of the compressor 42 extending upstream from the downstream end 44. An inlet 62 of the compressor 42 formed by the ID and outward flowpath boundaries 22, 24 and may have a larger cross-sectional area than other aspects of the compressor chamber 64 formed between the ID and outward flowpath boundaries 22, 24 downstream of the upstream end 40.

In the embodiment shown in FIG. 3, the OD flowpath boundary 24 may first decrease radially inward moving in the downstream direction towards the downstream end 44. Such a configuration may be necessary when a constraint exists that the OD flowpath boundary 24 at the downstream end 44 be further radially inward than at the inlet 62. Such a configuration may slightly decrease efficiency of the blades 16 and vanes 38 near the inlet 62 yet will increase efficiency near the downstream end 44 by an amount larger than the efficiency lost at the inlet 62 upon activation of the clearance reduction system 26. Thus, the net result is an increase in overall compressor efficiency.

As shown in the embodiment in FIG. 4, the OD flowpath boundary 24 may increase in distance radially outward when moving axially downstream in a direction from the upstream end 40 to the downstream end 44 in an axially downstream section 52 formed from less than 40 percent of an axial length of the compressor 42 extending upstream from the downstream end 44 of the compressor 42. The downstream section 52 of the OD flowpath boundary 24 may have a generally increasing slope in the downstream direction. In addition, the OD flowpath boundary 24 in a midstream section 70 upstream of the axially downstream section 52 may be generally linear between downstream and upstream sections 52, 54. The upstream section 54 of the OD flowpath boundary 24 may have a generally decreasing slope in the downstream direction. The OD flowpath boundary 24 may decrease in distance radially outward when moving axially downstream in a direction from the upstream end 40 to the downstream end 44 in an axially upstream section 54 formed from less than 20 percent of an axial length of the compressor 42 extending downstream from the upstream end 40 of the compressor 42.

The ID flowpath boundary 22 of FIG. 4 may increase in distance radially outward from a longitudinal axis 46 when moving axially downstream in a direction from the upstream end 40 to the downstream end 44 in a midstream section 60. In addition, the ID flowpath boundary 22, as shown in FIG. 4, may decrease in distance radially outward, thereby having a negative slope, when moving axially downstream in a direction from the upstream end 40 toward the downstream end 44 in an axially upstream section 56 formed from less than 20 percent of an axial length of the compressor 42 extending downstream from the upstream end 40 of the compressor 42. Immediately downstream from the upstream section 56, the ID flowpath boundary 22 of FIG. 4 may have an upper mid-section 66 with a positive slope in the downstream direction that is larger than the slope of the midstream section 60. The downstream section 58 may be up to about 40 percent of the length of the compressor 42 extending upstream from the downstream end 44. The ID flowpath boundary 22 of FIG. 4 in the downstream section 52 may have a positive slope greater than the slope in the midstream section 60. An inlet 62 of the compressor 42 in FIG. 4 formed by the ID and outward flowpath boundaries 22, 24 may have a larger cross-sectional area than other aspects of the compressor chamber 64 formed between the ID and outward flowpath boundaries 22, 24 downstream of the upstream end 40 and may extend downstream into a part of the upstream section 52 with a generally consistent cross-sectional area.

In the embodiment shown in FIG. 4, movement of the rotor assembly 28 by the clearance reduction system 26 will close the gaps 12 of the rear stage blades 16 and vanes 38. The compressor chamber 64 shown in FIG. 4 may be referred to as a mixed flow compressor because the flow towards the downstream end 44 has a radial component in addition to the primarily axial component.

During operation, the clearance reduction system 26 is operated to move the rotor assembly 28 axially generally along the longitudinal axis 46, as shown in FIG. 5. The rotor assembly 28 may be moved generally upstream to increase the efficiency of the turbine engine 20 by reducing the gaps 12. During shutdown of the turbine engine 20, the clearance reduction system 26 may move the rotor assembly 28 downstream to prevent tip damage.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A compressor airfoil tip clearance optimization system for increasing efficiency of a turbine engine by reducing the clearance between a tip of a compressor airfoil and a radially adjacent component of the turbine engine, comprising:

at least one generally elongated blade having a leading edge, a trailing edge, the tip section at a first end, and a root coupled to the blade at an end generally opposite the first end for supporting the blade and for coupling the blade to a disc of a rotor assembly;

at least one generally elongated compressor vane affixed to a stationary component such that the at least one generally elongated compressor vane does not rotate with a rotor assembly during turbine engine operation;

an ID flowpath boundary extending from generally an upstream end of a compressor to generally a downstream end of the compressor, wherein the ID flowpath boundary is formed in part from a compressor rotor assembly;

an OD flowpath boundary extending from generally the upstream end of the compressor to generally the downstream end of the compressor, wherein the OD flowpath boundary is formed in part from a compressor casing;

at least one clearance reduction system configured to move the rotor assembly axially to reduce tip clearance of the at least one generally elongated blade and the at least one generally elongated compressor vane;

wherein the ID flowpath boundary increases in distance radially outward from a longitudinal axis when moving axially downstream in a direction from the upstream end to the downstream end, wherein the ID flowpath boundary continuously increases in distance radially outward along an entire length between the upstream end and the downstream end;

wherein the ID flowpath boundary increases in distance radially outward when moving axially downstream in a direction from the upstream end toward the downstream end in an axially downstream section of the ID flowpath boundary formed from less than 40 percent of an axial length of the compressor extending upstream from the downstream end of the compressor; and wherein the axially downstream section of the ID flowpath boundary has a steeper slope increasing radially outward than a slope of a midstream section of the ID flowpath boundary upstream from the axially downstream section of the ID flowpath boundary.

2. A compressor airfoil tip clearance optimization system of claim 1, wherein the OD flowpath boundary is generally aligned with the longitudinal axis of the compressor in an axial direction.

3. A compressor airfoil tip clearance optimization system of claim 1, wherein the OD flowpath boundary increases in distance radially outward when moving axially downstream in a direction from the upstream end to the downstream end in an axially downstream section formed from less than 40 percent of an axial length of the compressor extending upstream from the downstream end of the compressor.

4. A compressor airfoil tip clearance optimization system of claim 3, wherein the OD flowpath boundary upstream of the axially downstream section is generally linear.

5. A compressor airfoil tip clearance optimization system of claim 3, wherein the OD flowpath boundary decreases in distance radially outward when moving axially downstream in a direction from the upstream end to the downstream end in an axially upstream section formed from less than 60 percent of an axial length of the compressor extending downstream from the upstream end of the compressor.

6. A compressor airfoil tip clearance optimization system of claim 3, wherein the OD flowpath boundary decreases in distance radially outward when moving axially downstream in a direction from the upstream end to the downstream end in an axially upstream section formed from less than 20 percent of an axial length of the compressor extending downstream from the upstream end of the compressor.

7. A compressor airfoil tip clearance optimization system for increasing efficiency of a turbine engine by reducing the clearance between a tip of a compressor airfoil and a radially adjacent component of the turbine engine, comprising:

at least one generally elongated blade having a leading edge, a trailing edge, the tip section at a first end, and a root coupled to the blade at an end generally opposite the first end for supporting the blade and for coupling the blade to a disc of a rotor assembly;

at least one generally elongated compressor vane affixed to a stationary component such that the at least one generally elongated compressor vane does not rotate with a rotor assembly during turbine engine operation;

an ID flowpath boundary extending from generally an upstream end of a compressor to generally a downstream end of the compressor, wherein the ID flowpath boundary is formed in part from a compressor rotor assembly;

an OD flowpath boundary extending from generally the upstream end of the compressor to generally the downstream end of the compressor, wherein the OD flowpath boundary is formed in part from a compressor casing;

at least one clearance reduction system configured to move the rotor assembly axially to reduce tip clearance of the at least one generally elongated blade and the at least one generally elongated compressor vane;

wherein the ID flowpath boundary increases in distance radially outward from a longitudinal axis when moving axially downstream in a direction from the upstream end to the downstream end;

wherein the OD flowpath boundary increases in distance radially outward when moving axially downstream in a direction from the upstream end to the downstream end in an axially downstream section of the OD flowpath boundary formed from less than 40 percent of an axial length of the compressor extending upstream from the downstream end of the compressor;

wherein the axially downstream section of the OD flowpath boundary has a steeper slope increasing radially outward than a slope of a midstream section of the OD flowpath boundary upstream from the axially downstream section of the OD flowpath boundary;

wherein the ID flowpath boundary increases in distance radially outward when moving axially downstream in a direction from the upstream end toward the downstream end in an axially downstream section of them ID flowpath boundary formed from less than 40 percent of an axial length of the compressor extending upstream from the downstream end of the compressor;

wherein the axially downstream section of the ID flowpath boundary has a steeper slope increasing radially outward than a slope of a midstream section of the ID flowpath boundary upstream from the axially downstream section of the ID flowpath boundary; and wherein a first blade of the at least one generally elongated blade and a first compressor vane of the at least one generally elongated compressor vane is located in the axially downstream section of the ID flowpath boundary and the axially downstream section of the OD flowpath boundary.

8. A compressor airfoil tip clearance optimization system of claim 7, wherein the OD flowpath boundary upstream of the axially downstream section is generally linear.

9. A compressor airfoil tip clearance optimization system of claim 8, wherein the OD flowpath boundary decreases in distance radially outward when moving axially downstream in a direction from the upstream end to the downstream end in an axially upstream section formed from less than 20 percent of an axial length of the compressor extending downstream from the upstream end of the compressor.

10. A compressor airfoil tip clearance optimization system of claim 8, wherein the ID flowpath boundary decreases in distance radially outward when moving axially downstream in a direction from the upstream end toward the downstream end in an axially upstream section formed from less than 20 percent of an axial length of the compressor extending downstream from the upstream end of the compressor.

11. A compressor airfoil tip clearance optimization system of claim 7, wherein the OD flowpath boundary decreases in distance radially outward when moving axially downstream in a direction from the upstream end toward the downstream end in an axially upstream section formed from less than 60 percent of an axial length of the compressor extending downstream from the upstream end of the compressor.

12. A compressor airfoil tip clearance optimization system of claim 7, wherein the ID flowpath boundary upstream of the axially downstream section of the ID flowpath boundary is generally linear.

13. A compressor airfoil tip clearance optimization system for increasing efficiency of a turbine engine by reducing the clearance between a tip of a compressor airfoil and a radially adjacent component of the turbine engine, comprising:

at least one generally elongated blade having a leading edge, a trailing edge, the tip section at a first end, and a root coupled to the blade at an end generally opposite the first end for supporting the blade and for coupling the blade to a disc of a rotor assembly;

at least one generally elongated compressor vane affixed to a stationary component such that the at least one generally elongated compressor vane does not rotate with a rotor assembly during turbine engine operation;

an ID flowpath boundary extending from generally an upstream end of a compressor to generally a downstream end of the compressor, wherein the ID flowpath boundary is formed in part from a compressor rotor assembly;

an OD flowpath boundary extending from generally the upstream end of the compressor to generally the downstream end of the compressor, wherein the OD flowpath boundary is formed in part from a compressor casing;

at least one clearance reduction system configured to move the rotor assembly axially to reduce tip clearance of the at least one generally elongated blade and the at least one generally elongated compressor vane;

wherein a midsection of the ID flowpath boundary is generally aligned with a longitudinal axis when moving axially downstream in a direction from the upstream end to the downstream end;

wherein the OD flowpath boundary increases in distance radially outward when moving axially downstream in a direction from the upstream end to the downstream end in an axially downstream section of the OD flowpath boundary formed from less than 40 percent of an axial length of the compressor extending upstream from the downstream end of the compressor;

wherein the axially downstream section of the OD flowpath boundary has a steeper slope increasing radially outward than a slope of a midstream section of the OD flowpath boundary upstream from the axially downstream section of the OD flowpath boundary;

wherein the ID flowpath boundary increases in distance radially outward when moving axially downstream in a direction from the upstream end toward the downstream end in an axially downstream section of the ID flowpath boundary formed from less than 40 percent of an axial length of the compressor extending upstream from the downstream end of the compressor;

wherein the axially downstream section of the ID flowpath boundary has a steeper slope increasing radially outward than a slope of a midstream section of the ID flowpath boundary upstream from the axially downstream section of the ID flowpath boundary;

wherein the OD flowpath boundary decreases in distance radially outward when moving axially downstream in a direction from the upstream end to the downstream end in an axially upstream section of the OD flowpath boundary formed from less than 20 percent of an axial length of the compressor extending downstream from the upstream end of the compressor;

wherein the ID flowpath boundary decreases in distance radially outward when moving axially downstream in a direction from the upstream end toward the downstream end in an axially upstream section of the ID flowpath boundary formed from less than 20 percent of an axial length of the compressor extending downstream from the upstream end of the compressor; and wherein a first blade of the at least one generally elongated blade and a first compressor vane of the at least one generally elongated compressor vane is located in the axially downstream section of the ID flowpath boundary and the axially downstream section of the OD flowpath boundary.

14. A compressor airfoil tip clearance optimization system of claim 13, wherein the OD flowpath boundary upstream of the axially downstream section of the OD flowpath boundary is generally linear.

* * * * *